United States Patent [19]

Wisdom

[11] Patent Number: 4,604,925

[45] Date of Patent: Aug. 12, 1986

[54] METHOD AND APPARATUS FOR SLICING PRODUCE

[75] Inventor: Lawrence W. Wisdom, Dallas, Tex.

[73] Assignee: Frito-Lay, Inc., Dallas, Tex.

[21] Appl. No.: 737,546

[22] Filed: May 24, 1985

[51] Int. Cl.[4] ..... B26D 3/28

[52] U.S. Cl. ..... 83/13; 83/403; 144/162 R; 144/373

[58] Field of Search ..... 83/13, 403, 404.3, 404.1, 83/411 R, 856; 144/162 R, 172, 373

[56] References Cited

U.S. PATENT DOCUMENTS

| | | | |
|---|---|---|---|
| 2,859,784 | 11/1958 | Woodward et al. | 83/403 |
| 3,123,114 | 3/1964 | Andrews et al. | 146/3 |
| 3,139,128 | 6/1964 | Urschel et al. | 83/13 |
| 3,139,130 | 6/1964 | Urschel et al. | 83/13 |
| 3,857,310 | 12/1974 | Tiby | 83/26 |
| 3,913,643 | 10/1975 | Lambert | 144/172 |
| 4,206,671 | 6/1980 | Hoehn | 83/408 |
| 4,301,846 | 11/1981 | Berggren | 144/162 R |
| 4,391,172 | 7/1983 | Galland et al. | 83/403 |
| 4,523,503 | 6/1985 | Julian | 83/403 |

*Primary Examiner*—Donald R. Schran

*Attorney, Agent, or Firm*—Bernard, Rothwell & Brown

[57] ABSTRACT

Pieces of produce are sliced in a centrifugal slicer having an impeller rotating within a cylindrical slicing head having one or more slicing knives, the slicing head being rotated in the same direction as the impeller but at a rotational speed less than that of the impeller. This results in significantly less waste and scrap as compared to a conventional commercial slicer.

16 Claims, 2 Drawing Figures

METHOD AND APPARATUS FOR SLICING PRODUCE

BACKGROUND OF THE INVENTION

1. Field of the Invention

This invention relates to improvements in a method and apparatus for slicing produce.

2. Description of the Background Art

Centrifugal slicers for slicing produce are well known in the art. One commercially available slicer is the Urschel Model CC slicer manufactured and sold by Urschel Laboratories, Inc., Valparaiso, Ind. The Urschel Model CC centrifugal slicer was designed for slicing potatoes for potato chips as a primary consideration, but it is also capable of producing slices from a wide variety of other produce, including raw apples, beets, mushrooms, and the like.

In the operation of a centrifugal slicer such as the Urschel Model CC, produce enters a rotating impeller and is forced against the inner surface of a stationary slicing head assembly, which consists of eight separate slicing heads and knives. It is necessary that the impeller of a centrifugal slicer rotate at a relatively high rate of speed, so that the pieces of produce are pushed with sufficient centrifugal force against the slicing knives for cutting or slicing. For example, in the production of potato slices, impeller speeds of at least about 150 r.p.m. are generally utilized and, depending on the desired throughput, impeller speeds of over 350 r.p.m. may be used. A slice is produced as each potato passes each knife blade.

Although relatively high impeller speeds are required to force the produce pieces against the inner surface of the slicing head assembly and the slicing knife to slice the produce, centrifugal slicers generally produce a considerable amount of waste and scrap during the slicing operation. For example, centrifugal slicing of potatoes to form potato slices for chips often results in the loss of up to 8% or more of potato solids in the form of starch, which is washed down the drain when the slices are washed before frying.

Another significant source of scrap generated by the use of centrifugal slicers is scrap resulting from "missed first cuts." The first cut on round produce such as a potato tends to spin it, and several cuts may be made before the potato sits in one position against the slicer head. Scrap generated from "missed first cuts" may be as high as 2% or more.

Another source of scrap results from slicing which occurs near the end of a produce piece, where there is a tendency for the remainder of the produce piece to buckle, resulting in knife blade cuts too close to the existing cut surface.

Accordingly, there is a need in the art for a centrifugal slicer which produces substantially less waste and scrap.

SUMMARY OF THE INVENTION

The present invention relates to a method and apparatus for slicing produce wherein an impeller for receiving and carrying the produce cooperates with a cylindrical slicing head on which slicing knives are mounted to slice the produce. The impeller is rotated to centrifugally force a piece of produce against the slicing head knives, and the slicing head is also rotated in the same direction as the impeller, but at a rotational speed less than that of the impeller, to slice the piece of produce with significantly less waste and scrap.

DESCRIPTION OF THE PREFERRED EMBODIMENT

Figure 1:
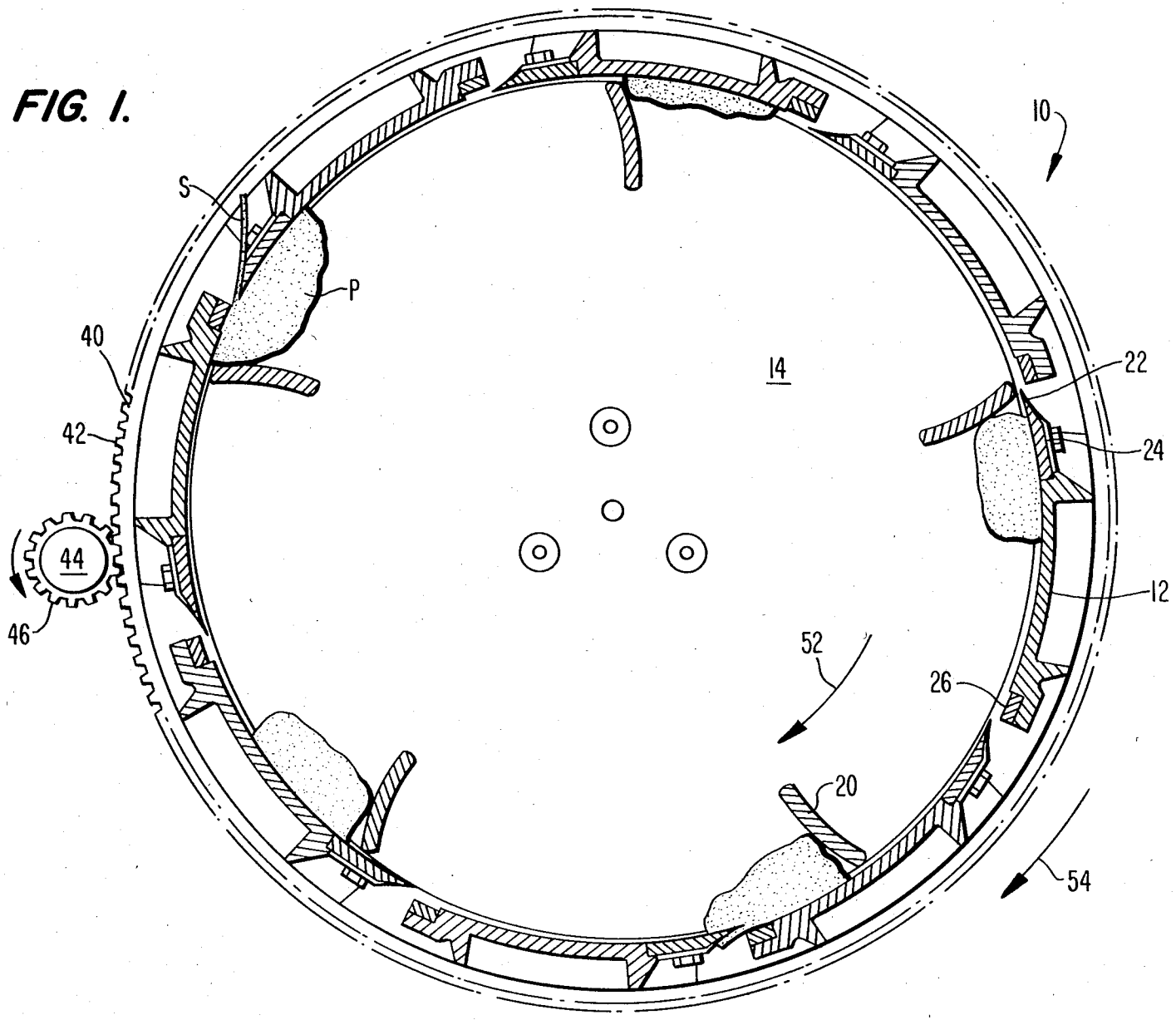
FIG. 1 is a top plan view of a centrifugal slicer according to the invention.
Figure 2:
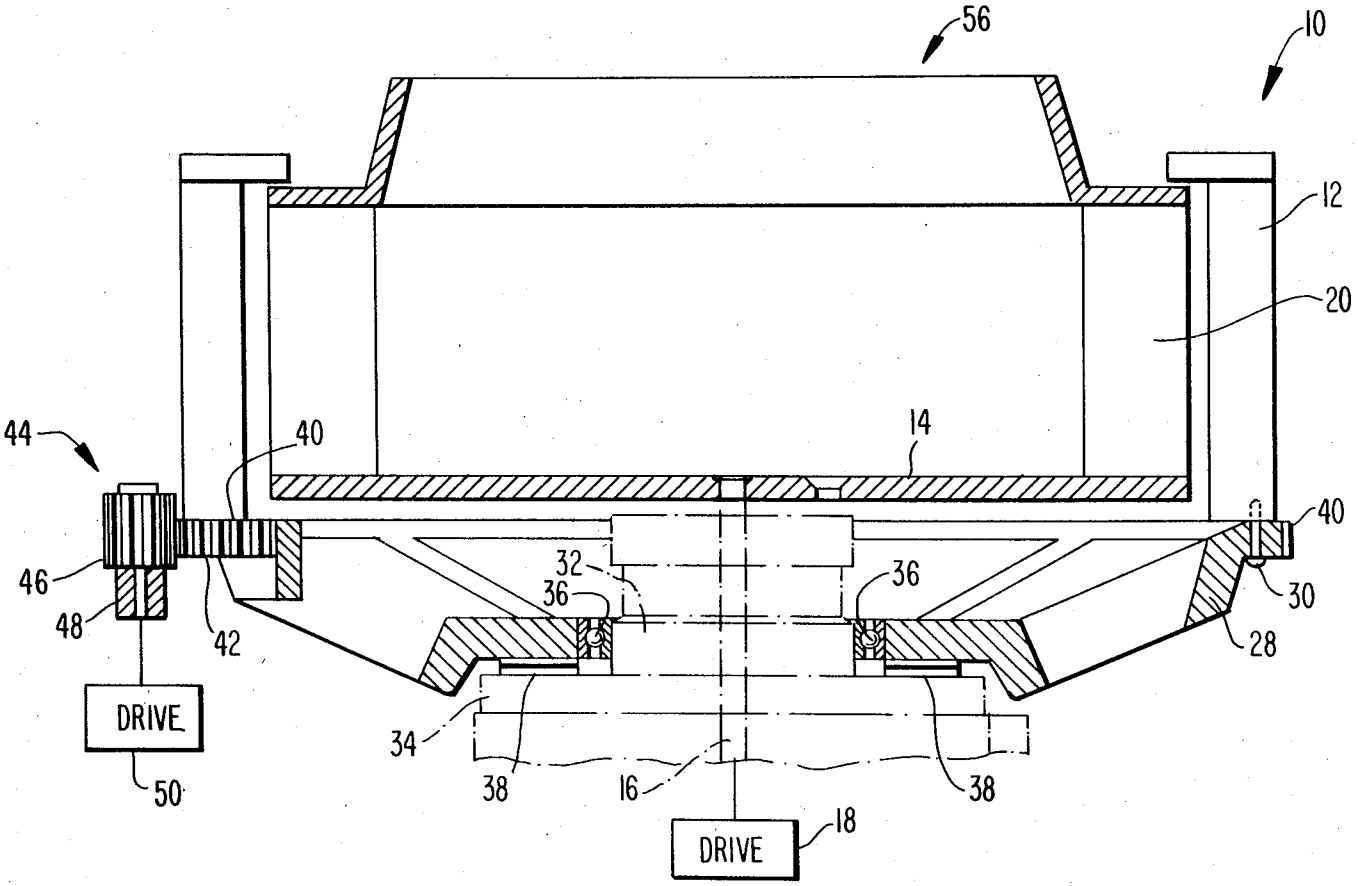
FIG. 2 is a sectional elevation view of the centrifugal slicer shown in FIG. 1.

A centrifugal slicer 10 according to the present invention includes an impeller 14 which is rotatable by a drive shaft 16 from a suitable drive 18. The impeller carries a plurality of blades 20 for receiving and carrying articles to be sliced such as potatoes.

The slicer 10 includes a cylindrical slicing head assembly 12 which forms a generally cup-shaped enclosure within which impeller 14 is rotatable.

Each blade 20 of impeller 14 pushes in front of it an individual potato P (or other item(s) of produce) to be sliced by forcing each potato against a plurality of knives 22 fixedly mounted in slicing head assembly 12. As shown, there are eight knives 22 mounted in slicing head assembly 12, each of which is suitably held in place by a knife clamp 24.

Impeller 14 includes five blades 20, so that in operation, the impeller blades 20 are forcing five potatoes at a time around the periphery to be sliced by eight different slicing knives so that a plurality of slices S pass outwardly between the gate inserts 26 and the knives 22.

This invention modifies the above-described typical centrifugal slicer, such as the Urschel Model CC slicer manufactured by Urschel Laboratories, Inc. of Valparaiso, Ind., by co-rotating both the impeller 14 and the slicing head assembly 12, rather than having a stationary slicing head assembly as in the Urschel Model CC.

According to this invention, the centrifugal slicing head 12 is rotated in the same direction as the impeller 14, but at a rotational speed less than that of the impeller. This can be accomplished by providing a rotatable slicing head support 28.

The slicing head support 28 can be fixedly attached to the slicing head assembly 12 by means of screws 30. Bearing means are provided for rotation of the slicing head support 28 about the drive shaft support 32 and the drive housing 34. These bearing means may include a race of ball bearings 36 between the slicing head support 28 and the drive shaft support 32, as well as a race of roller bearings 38 between the slicing head support 28 and the drive housing 34. The bearing means 36 and 38 provide for rotation of the slicing head 12 independently of the impeller 14.

A gear 40 including a plurality of gear teeth 42 is peripherally attached to the slicing head support 28, and thus operably connected to the slicing head 12.

Gear 42 is driven by a second gear 44 including a plurality of teeth 46 which mesh with the teeth 42 of slicing head support gear 40. Gear 44 is rotatable by a drive shaft 48 from a suitable drive 50.

According to this invention, the impeller 14 of a slicer 10 rotates in the direction shown by arrow 52 in FIG. 1. For slicing potatoes, the impeller speed is generally within the range of from about 150 r.p.m. to about 400 r.p.m. The slicing head 12 is rotated in the same direction (arrow 54) as the impeller, but at a rotational speed less than that of the impeller. It is preferred that the rotational speed of the slicing head be from about 50% to about 95% of the rotational speed of the impeller.

According to the method of this invention, pieces of produce such as potatoes are fed to impeller 14 through in-feed opening 56 in slicer 10. Impeller 14 is rotated sufficiently to centrifugally force the potatoes against the slicing head knives 22 with the slicing head rotating in the same direction as the impeller but at a rotational speed less than that of the impeller, to slice the potatoes.

It was surprisingly discovered that co-rotation of the slicing head 12 and the impeller 14 as described above results in substantially less waste and scrap than conventional slicing with a rotating impeller but a stationary slicing head.

Close-up inspection of conventionally sliced potato slices and potato slices sliced according to this invention shows that co-rotation of the impeller and slicing head produces slices with substantially fewer ruptured surface cells than conventionally produced slices. This reduction in ruptured cells reduces solids loss from potato slices by as much as 15% to about 40%.

Scrap loss due to "missed first cuts" of small tubers using conventional centrifugal slicers can be as high as 20%. Co-rotation of the impeller and slicing head according to the present invention has been found to decrease the scrap from small tubers due to "missed first cuts" to as low as about 5% or less.

Co-rotation of impeller and slicing head produces smoother cut surfaces with fewer ruptured surface cells than conventional slicing. The reduction in ruptured cells on cut surfaces of potato slices has been found to reduce oil uptake of the slices during frying by as much as 4%. Apparently, ruptured cells on the cut surfaces provide places for the oil to be held and perhaps get into the interior regions of the potato slices during frying. The smooth surfaces of chips sliced according to the present invention seem to provide a barrier to absorbtion of oil by slices during frying.

The advantages of this invention cannot be realized by merely reducing the rotational speed of a conventional slicer with a stationary slicing head, since the necessary reduction in impeller speed does not impart sufficient centrifugal force to the potatoes to properly slice them. By co-rotating the impeller and slicing head, sufficient centrifugal force is provided the potatoes for slicing while avoiding the disadvantages of conventional slicers.

It can be seen that the present invention provides a practical means for reducing the waste and scrap which has normally been associated with centrifugal slicers. The invention is further illustrated by the following examples which are not intended to be limiting.

EXAMPLE I

Raw potatoes ranging in size from less than 40 g to over 400 g were sliced to compare waste and scrap generation of conventional slicing with an Urschel Model CC slicer at 360 r.p.m. impeller speed (stationary slicing head) with slicing at 360 r.p.m. impeller speed in combination with a co-rotating slicing head at 75% of impeller speed. The scrap generated by the co-rotating slicer was 22% that of the scrap generated by the conventional slicer with the stationary slicing head, for all size tubers, i.e., a 78% reduction in scrap. For larger tubers, the scrap generated by the co-rotating slicer was 40% of that generated by the conventional slicer with the stationary slicing head.

EXAMPLE II

Potatoes were also sliced at 160 r.p.m. with a stationary slicing head, 160 r.p.m. with 50% co-rotating slicing head, 160 r.p.m. with 75% co-rotating slicing head, as well as 260 r.p.m. with stationary slicing head, 260 r.p.m. with 50% co-rotating slicing head, and 260 r.p.m. with 75% co-rotating slicing head. At both 160 r.p.m. and 260 r.p.m. impeller speed, 50% and 75% co-rotation of the slicing head resulted in a substantial reduction in scrap and waste as compared to conventional (stationary slicing head) slicing.

What is claimed is:

1. A centrifugal slicer comprising (a) an impeller for receiving an article to be sliced, the impeller including means for carrying an article to be sliced;

(b) means for rotating the impeller so that an article to be sliced being carried by the impeller is centrifugally forced in an outward direction;

(c) a cylindrical slicing head adapted for cooperation with the impeller so that an article to be sliced is rotated by the impeller within the slicing head, the slicing head including at least one knife for slicing an article when said article is centrifugally forced against the knife during rotation of the impeller; and (d) means for rotating the cylindrical slicing head in the same direction as the impeller but at a rotational speed less than that of the impeller.

2. The slicer of claim 1 wherein the slicing head includes a plurality of slicing knives.

3. The slicer of claim 1 wherein the impeller rotating means rotates the impeller at from about 150 r.p.m. to about 400 r.p.m.

4. The slicer of claim 2 wherein the impeller rotating means rotates the impeller at from about 150 r.p.m. to about 400 r.p.m.

5. The slicer of claim 1 wherein the slicing head rotating means rotates the slicing head at from about 50% to about 95% of the rotational speed of the impeller.

6. The slicer of claim 2 wherein said slicing head rotating means rotates the slicing head at from about 50% to about 95% of the rotational speed of the impeller.

7. The slicer of claim 3 wherein said slicing head rotating means rotates the slicing head at from about 50% to about 95% of the rotational speed of the impeller.

8. The slicer of claim 4 wherein said slicing head rotating means rotates the slicing head at from about 50% to about 95% of the rotational speed of the impeller.

9. A method for slicing produce in a centrifugal slicer of the type having an impeller for receiving and carrying an article to be sliced, which impeller cooperates with a cylindrical slicing head having at least one slicing knife, the method comprising:

(a) feeding an article to be sliced to the impeller, (b) rotating the impeller to centrifugally force the article against the slicing head knife, and (c) rotating the slicing head in the same direction as the impeller, but at a rotational speed less than that of the impeller, to slice the article while simultaneously reducing waste and scrap.

10. The method of claim 9 wherein said slicing head includes a plurality of slicing knives.

11. The method of claim 9 wherein, the impeller is rotated at from about 150 r.p.m. to about 400 r.p.m.

12. The method of claim 10 wherein the impeller is rotated at from about 150 r.p.m. to about 400 r.p.m.

13. The method of claim 9 wherein the slicing head is rotated at from about 50% to about 95% of the rotational speed of the impeller.

14. The method of claim 10 wherein the slicing head is rotated at from about 50% to about 95% of the rotational speed of the impeller.

15. The method of claim 11 wherein the slicing head is rotated at from about 50% to about 95% of the rotational speed of the impeller.

16. The method of claim 12 wherein the slicing head is rotated at from about 50% to about 95% of the rotational speed of the impeller.

* * * * *